US006962541B2

(12) United States Patent
Mitzak

(10) Patent No.: US 6,962,541 B2
(45) Date of Patent: Nov. 8, 2005

(54) APPARATUS FOR A LACROSSE STICK HEAD

(76) Inventor: Kevin Michael Mitzak, 19 Marshall Rd., Hillsborough, NJ (US) 08844

( * ) Notice: Subject to any disclaimer, the term of this patent is extended or adjusted under 35 U.S.C. 154(b) by 0 days.

(21) Appl. No.: 10/376,101

(22) Filed: Mar. 1, 2003

(65) Prior Publication Data

US 2003/0181271 A1 Sep. 25, 2003

Related U.S. Application Data

(60) Provisional application No. 60/361,915, filed on Mar. 4, 2002.

(51) Int. Cl.[7] ..... A63B 59/02
(52) U.S. Cl. ..... 473/513; 473/553
(58) Field of Search ..... 473/512–514, 473/505, 543, 553, 540, 528, 557; 84/306; D21/724, 521, 522, 534, 539

(56) References Cited

U.S. PATENT DOCUMENTS

| | | | | | |
|---|---|---|---|---|---|
| 240,183 | A | * | 4/1881 | Richardson | 473/534 |
| 1,140,282 | A | * | 5/1915 | Parsons | 473/534 |
| 4,013,290 | A | * | 3/1977 | Stevens | 473/534 |
| 4,061,333 | A | * | 12/1977 | Shaps | 473/534 |
| 5,967,912 | A | * | 10/1999 | Hexemer et al. | 473/513 |
| 6,066,056 | A | | 5/2000 | Morrow | |
| 6,186,912 | B1 | | 2/2001 | Gait | |
| 6,213,901 | B1 | | 4/2001 | Collinson | |
| 6,447,410 | B2 | | 9/2002 | Crawford | |
| RE37,894 | E | | 10/2002 | MacNeil | |
| 6,506,132 | B1 | | 1/2003 | Brine, III et al. | |
| 6,520,875 | B1 | | 2/2003 | Crawford | |
| 2002/0107094 | A1 | | 8/2002 | LeMire | |
| 2002/0160865 | A1 | | 10/2002 | Brine, III et al. | |

* cited by examiner

*Primary Examiner*—Gregory Vidovich
*Assistant Examiner*—M. Chambers
(74) *Attorney, Agent, or Firm*—Gerald J. Smit

(57) ABSTRACT

An apparatus used in playing the sport of lacrosse. The apparatus is located in a lacrosse player's stick head. During lacrosse play, a player may find it advantageous to use this invention to finely adjust the lengths and tensions of the thongs or netting material of the lacrosse stick head. In addition, this invention relates to the shooting string apparatus located in the head of a lacrosse stick and its adjustment. In this invention, the shooting string apparatus is constructed with a flat central piece called the shooting string section and a tension adjustment device. Affixed to the shooting section are a series of opposed flaps that fold over and hold the shooting string in place within the stick head. A tension string is connected to or through the shooting string section. The tension on the shooting string section may be easily and rapidly adjusted by controlling the length of the tension string by operating a finely continuously adjustable locking mechanism. The shooting string of this invention can be quickly and easily moved from one stick head to another and the tension on the installed shooting string may be quickly and easily adjusted by a locking mechanism. The adjustable locking mechanism simplifies the task of adjusting the shooting strings and makes adjustments more accurate and permanent

11 Claims, 4 Drawing Sheets

7
26
33
8
7
22
10
5
7
23
12
8
35
8
8
11
20
9
17
7
31
7
7
7
16
19
30
21

APPARATUS FOR A LACROSSE STICK HEAD

CROSS-REFERENCES TO RELATED APPLICATIONS

This application claims the benefit of the filing date of U.S. Provisional Application No. 60/361,915, filed Mar. 4, 2002, which is hereby incorporated by reference in its entirety and included herein as if set forth at length.

STATEMENT REGARDING FEDERALLY SPONSORED RESEARCH OR DEVELOPMENT

Not Applicable.

REFERENCE TO SEQUENCE LISTING,A TABLE, OR A COMPUTER PROGRAM LISTING COMPACT DISK APPENDIX

Not Applicable.

FIELD OF THE INVENTION

This invention relates to lacrosse stick head flexible elements and their adjustment.

BACKGROUND OF THE INVENTION

This invention is used in the sport of lacrosse, which is considered the oldest team contact sport of North America. The sport of lacrosse is played with sticks used for catching, carrying, and throwing a ball into the opposing team's goal. Lacrosse sticks have a handle and a head. The head of the stick is a frame. Strung across the head frame with varying degrees of looseness and tension are flexible elements such as strings, thongs and/or netting material. Within the head frame, the thongs and/or netting material are typically strung either traditionally (a complex pattern of leather and nylon strings woven together) or in mesh (a piece of mesh material attached to the head by nylon strings) to create what is known as a pocket. According to the jargon of the sport, a ball in play will be held in the pocket. The pocket is an area of slack in the flexible elements. And the determining factor to how each individual pocket throws (the degree up or down out of the pocket when the ball is released) is the tension controlled by the shooting strings.

In the lexicon of the sport, the word "tension" does not carry the meaning that an engineer would use in the sense of a force being applied. Rather, players of the sport use the word "tension" to identify the amount of slack or excess length in a flexible element.

In the act of throwing or shooting, the stick is swung in an arc and the ball, which is initially located around the center of the pocket, begins to travel away from the center of the arc out of the pocket due to centrifugal force. While the ball is accelerating out of the pocket, it remains in constant contact with the pocket and the friction created when the ball passes over the shooting strings determines the degree up or down the ball will travel once released from the pocket. The greater the tension of the shooting strings, the greater the downward angle the ball will follow after hitting the strings. The lesser the tension, the greater the upward angle the ball will follow since there is not as much friction redirecting it down.

There may be some players who do not use shooting strings and prefer to use graduated tensions in the flexible elements. However, the majority of players prefer to add shooting strings into the stick head flexible elements.

Most players of the sport use more than one shooting string in their stick head pocket. The reason for this is to provide a more fluent release from the stick head pocket. This is achieved by staggering the differences in tension throughout multiple shooting strings, where the first shooting string the ball comes in contact with contains the least amount of tension among the shooting strings, and the amount of tension becomes gradually greater with each shooting string the ball comes in contact with. This eliminates the abrupt release experienced when there is only one shooting string and the ball experiences a great amount of friction all at once instead of small amounts of friction gradually. A small amount of friction gradually creates a smooth, fluid release most players of the sport prefer. However, every player is different and has his/her own personal preference as to how the ball is released from their pocket, so best release option, whether a smooth, gradual release or a hard, abrupt release remains up to each individual players taste. It is very difficult to create the perfect tension for your style of throwing/shooting, and even when the perfect tension is found, it is extremely difficult to maintain that tension over long periods of time.

Until now, the shooting string has been nothing more than common string-like material. This was intricately interwoven into the pocket, and wound over itself repeatedly. This is not only very difficult, but creates the problem of permanence, making it extremely hard to add and remove the strings. Once in place, the degree of tension had to be guesstimated by hand, and when the appropriate degree of tension was thought to be found, the string had to be quickly tied in knots by hand, hoping to not have altered the tension in the process. The problem here is that since the player is guesstimating and tying knots by hand, it becomes a very long and tedious task trying to find the perfect tension and maintaining that exact tension once found. In addition, once the player finds the perfect tension, it takes only weeks, days, and sometimes even hours before the knots loosen causing wild throws.

There are many different reasons causing the shooting string knots to become undone. The main reason would probably be due to the weather, lacrosse is an outdoor sport so the lacrosse sticks are exposed to nearly all forms of natural elements. The most common element would have to be rain, when the shooting strings become wet, they expand in size and are more susceptible to be stretched when force is applied to them. While playing the game of lacrosse, each player must catch and throw the ball numerous times. Each time these actions are performed force is applied to the shooting strings casing them to stretch and their knots to loosen. Once this happens, the tension in the shooting strings becomes distorted causing the ball to be released from the sticks pocket differently, ultimately resulting in throws/shots being very off target to no fault of the player, but by fault of the shooting strings.

Even when not raining shooting string knots have a way of coming undone at the most inopportune times. When the knots do come untied, it is a very unpleasant process to correct this problem. If this should happen during a practice, a player is forced to call a timeout and be replaced. The player must go to the sideline and attempt many various tensions until the player finally finds the appropriate tension. Meanwhile, the player is missing practice.

Although the practice situation of untied knots or stretched strings is annoying, it may just be the best case scenario for a player's shooting strings to fail. For example, imagine playing in a championship game and with your team down by one with only seconds left in the game. The wear and tear of a full game's worth of applied forces to your shooting strings has caused their knots to loosen without your knowing it. The knots finally give way and become undone just as you become open mere feet in front of the opposition's goalkeeper. Your teammate delivers a perfect pass to you with three seconds left on the clock giving you the perfect opportunity to tie the game and send it into overtime. You wind up and deliver your shot; and you can see in your mind's eye the ball entering the goal before you even release it. Then, to your horror, you see the ball sailing away, completely off line from its intended target. Your heart drops as you realize what must have happened as you watch your shot travel into the parking lot and the opposition begin to celebrate. You blew it, or should I say, your shooting strings blew it. There is no worse feeling then wondering if that shot would have scored if your shooting strings had remained at the tension you were used to, the tension you were expecting when you took that final shot.

BRIEF SUMMARY OF THE INVENTION

The present invention pertains to in the sport of lacrosse. The present invention overcomes most of the problems of the prior art enumerated above.

The invention enables fine and continuous adjustment of the flexible elements of a lacrosse stick head by feel alone and makes a new shooting string apparatus available for use. Specifically, this invention relates to the adjustment of thongs and/or netting material on the heads of the sticks and even more specifically to a more easily adjustable than prior art stick head shooting string. The invented shooting string may be easily and rapidly attached to the thongs and/or netting material on the stick head. The proposed stick head shooting strings provide a capability to more accurately and controllably launch a ball over an extended period of time at a target location due to the ability to repeatedly and easily refine the equipment settings.

The new invention achieves the following: simplifies the adjusting of the shooting strings, makes adjustments more refined, accurate and permanent, and enables the string to be switched from one stick to another stick quickly and easily. The invention involves adjustment devices that may be integrated into a stick head or added as attachments to existing stick heads. The invention also provides for apparatus that may be transferred between sticks, a feature that may appeal to the cost conscious player or a player with a limited budget.

An object of the invention is to provide rapid, accurate, fine, continuous and repeatable adjustment of the flexible elements of head of a lacrosse stick to counteract the tendency of the flexible elements of head of a lacrosse stick to loose tuning. The invention also provides for gradual changes to the shape of the lacrosse stick pocket in response to playing conditions or the skill or tactics of the immediate opponent. Through the use of the tension adjusting mechanisms, gradual and predictable changes may be made. The changes may be made even during the course of play, a heretofore unthinkable activity.

A further objective of this invention is to provide a shooting string that is easier to install and tune than the shooting strings of the prior art. The ability to easily add or remove shooting strings by merely releasing tabs possesses many advantages over interweaving or removing the interweaving of additional thongs, strings or other flexible elements.

This invention is distinguished from the teachings in the LACELOCK FOR A LACROSSE STICK HEAD U.S. Pat. No. 5,967,912 invented by Hexemer et al in that the invention herein teaches the use of a finely and continuously adjustable metering and holding lock of the flexible elements of the stick head. In contrast, Hexemer's patent in the prior art only teaches the use of locking arrangements for gross adjustments. According to the teachings of Hexemer's patent, the player must release Hexemer's locking arrangement and then tug on the string while being unable to judge how much the string will move in response to the tug, and then relock the string. Hexemer's patent also teaches the use of locking arrangements that require the player to look at the locking arrangement while making adjustments and, in some cases, use tools. The invention herein allows adjustments to be made by feel while the player is actually playing the game while the player must focus all visual attention on the movement of play. To look down at the stick while play moves on as prior art patent teaches puts the player at a serious disadvantage compared to the invention herein that only requires tactile sensing to perform adjustments.

This invention is distinguished from the teachings in the LACROSSE STICK POCKET SHOOTING STRINGS AND THONG ELEMENTS U.S. Pat. No. 6,447,410 invented by Crawford in that the invention herein teaches the use of flexible elements that are attached to but not interwoven with the other flexible elements of the stick head. In contrast, Crawford's patent only teaches that the flexible elements must be interwoven. The invention herein allows the easy transfer of the shooting string apparatus from one stick to another without the need to remove interwoven components. To remove interwoven components as Hexemer's patent teaches puts the player at a serious disadvantage compared to the invention herein that only requires lifting out the shooting string section.

BRIEF DESCRIPTION OF THE SEVERAL VIEWS OF THE DRAWING

Note: Figures are not to scale.

DETAILED DESCRIPTION OF THE PREFERRED EMBODIMENTS OF THE INVENTION

Figure 1:
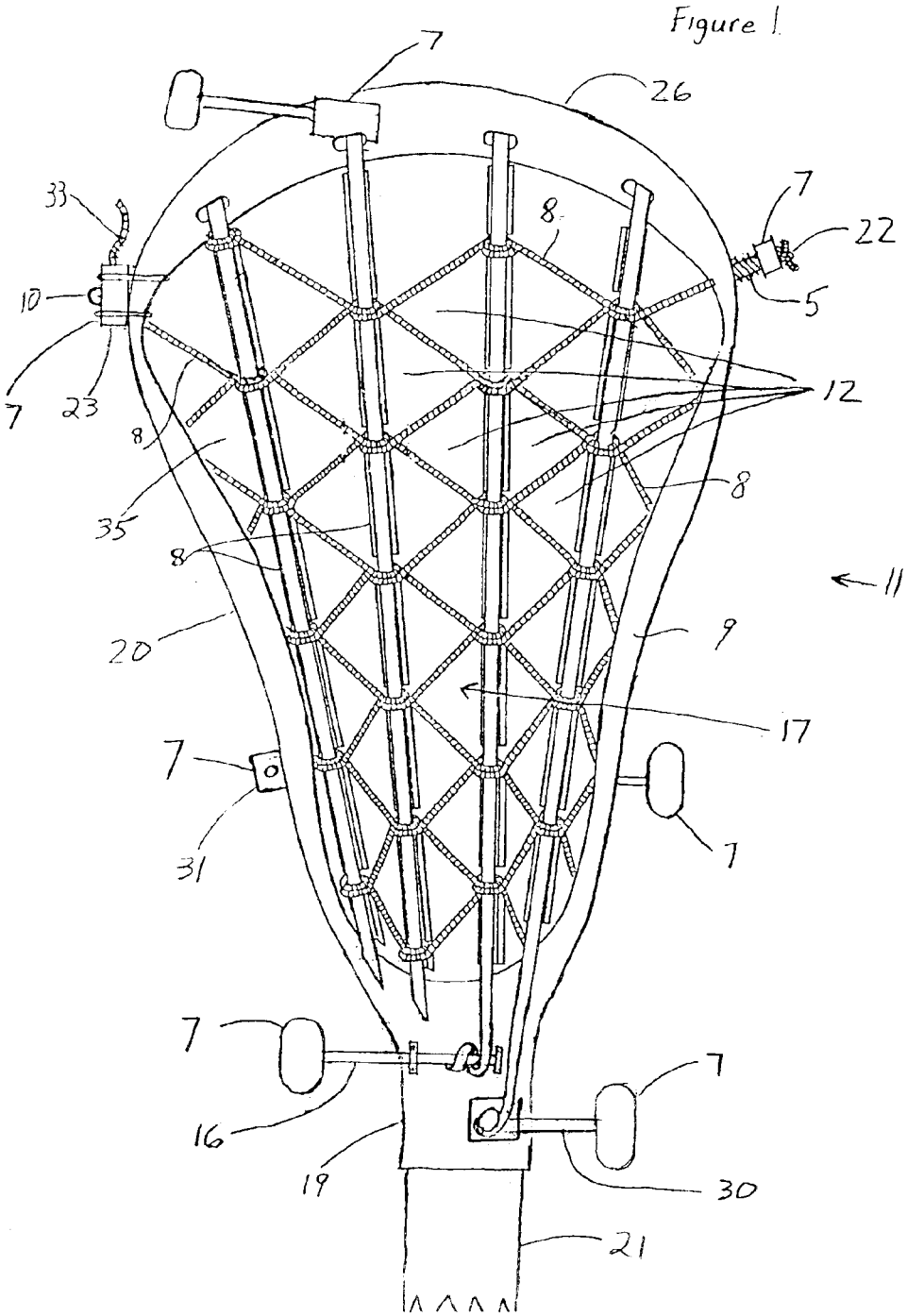
FIG. 1 is a perspective view of the front of a lacrosse stick head showing several different types of finely continuously adjustable mechanisms in different placements for changing the lengths/tensions of the flexible elements.

Referring to FIG. 1 of the drawings that shows a lacrosse stick head 11 mounted on a lacrosse stick 21, several different types of finely continuously adjustable mechanisms 7 for changing and holding the lengths/tensions of the flexible elements 8 may be used. Many potential alternative types of finely continuously adjustable mechanisms for accomplishing the objectives of this invention are known in the art but are not exhaustively identified. Shown are a violin/guitar type adjusting mechanism 30, 31; an extending and retracting hollow screw 5 through which the flexible element 8 extends axially through the hollow center and then is tied in a knot 22 or otherwise expanded to provide a thickening that will not slip down the hollow center when the length of the screw is adjusted; a spooling arrangement 16 that may be finely ratcheting for improved holding; and a friction wheel 10. The friction wheel 10 is shown mounted in a detachable tension box or housing 23. The excess flexible element 33 beyond the holding point of the friction wheel 10 is also shown. Any type of finely continuously adjustable mechanism may be used in the tension box 23. In actual application, a lacrosse stick head 11 may only be equipped with a single type of mechanism 7, though any combination of multiple types, both shown and not articulated, is also foreseeable. The finely continuously adjustable mechanisms 7 may control the lengths/tensions of any number of the flexible elements 8, from one to all. The detachable tension box 23 may be fastened by any known means to the stick head frame 9 including screw, tape, elastic bands or other spring elements, clips, clamps, or tying. The finely continuously adjustable mechanisms 7 may be located in any position or in any plane on the head frame 9. For example, a transverse plane violin/guitar type adjusting mechanism 30 is shown as well as a perpendicular to that plane mechanism 31 for which we only see the end view in FIG. 1. The finely continuously adjustable mechanism 7 also serves to lock the flexible element in place. In some stick head designs where there may be voids in the side wall 20, top portion component of the head 26, and base portion component of the head 19, the finely continuously adjustable mechanism 7 may be contained within the voids. In FIG. 1, the spaces between the flexible elements 8 of the stick head 11 are empty space. The lower portion of the flexible elements within the stick head frame 9 is the pocket, an area generally shown as 17. The invention provides for adjustably tuning the lengths of the flexible elements 8 that comprise the pocket 17 to achieve the desired depth of the pocket 17 and at the same time having the flexible elements 8 located in the upper, shooting area of the stick head, generally shown as area 12, possess a gradually and continuously re-adjustable lesser relative length and correspondingly greater relative tension.

Figure 2:
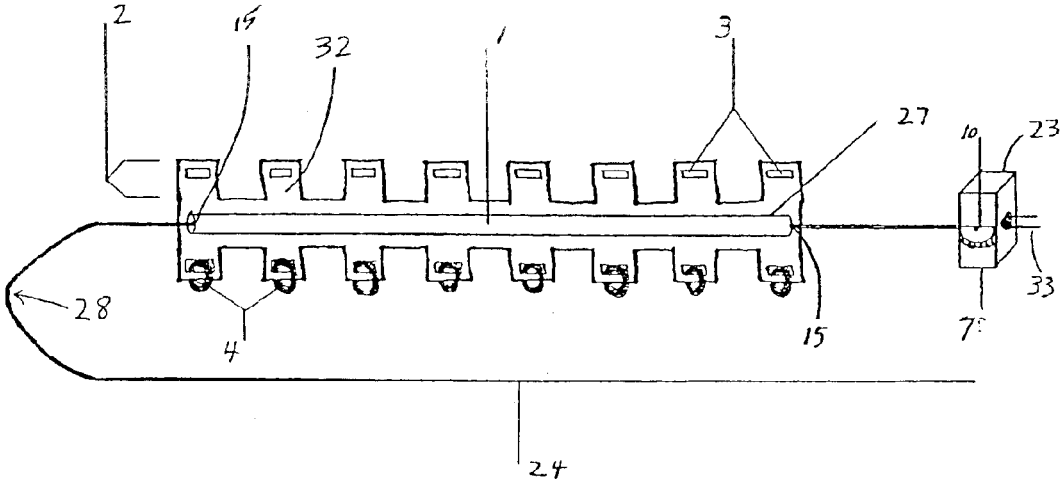
FIG. 2 is the shooting string section with the flaps open and the closed rings hanging on the lower row of flaps as viewed looking into the front side of the pocket in which the ball would sit during play. This is the view of the shooting string section with the flaps before it is fastened into the stick head.

Besides or alternative to increasing the tension of the flexible elements 8 in the shooting area of the stick head generally shown as area 12, an alternative preferred embodiment of this invention is the use of a shooting string section 1. Several preferred embodiments of the shooting string section 1 are shown in FIGS. 2 through 5. FIG. 2 shows an embodiment of the shooting string section 1 before it is fastened into area 12 of the stick head. In this embodiment shooting string section 1 is placed on the flexible elements and the flaps are partially or totally wrapped around the flexible elements 8 of the shooting sting area 12. The shooting string section 1 is not interwoven with the flexible elements 8 as none of the flexible elements 8 pass in front of the shooting string section 1. Any fastening means may be used to connect the flaps 2 together to constrain the shooting string section 1 against the shooting string area 12 flexible elements 8. One means to connect the flaps 2 together is by the use of connector rings 4. In FIG. 2 the shooting string section 1 is shown with the flaps 2 spread open and the closed connector rings 4 hanging in holes, also named channels 3, in the flaps 2 on the lower row of flaps 2 as viewed looking into the side of the pocket1 17 in which the ball would sit during play. This is the view of the shooting string section 1 with the flaps 2 in spread position before the shooting string section 1 is fastened into the stick head 11. The flexible element thongs or netting material 8 of the stick head 11 is not shown. In this FIG. 2, the various elements are displayed close to, but not in exact, relative scale with each other. This presentation of FIG. 2 is called the front face view. In this FIG. 3, a tension box 23 with a friction wheel 10 is shown as the finely continuously adjustable mechanism 7, though ant type of finely continuously adjustable mechanism may be used to meter the length and hold the tension element 24. When a shooting string section 1 is used, a tension element 24 assists in controlling the tension in the shooting string area 12. The tension on the tension element may be controlled by the traditional method of tying or by the use of a finely continuously adjustable mechanism 7.

Figure 4:
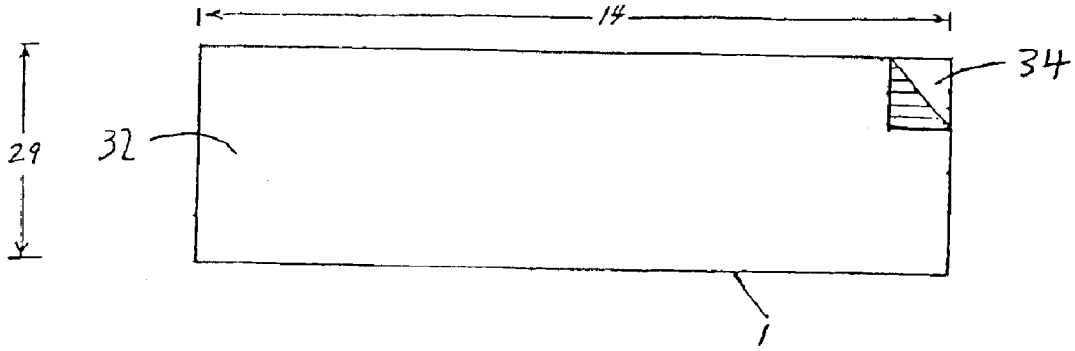
FIG. 4 is an alternative embodiment of the shooting string section without flaps and without any tube. In one alternative preferred embodiment of the shooting string material, two layers of material will be fastened along the long edges allowing the tension string to extend between the layers of material.

In one alternative preferred embodiment the tension string 24 extends through the shooting string section through a tube 27. In another alternative preferred embodiment the tension string 24 extends through shooting string section 1 between two layers of the shooting string material. In FIG. 2 this would appear as the string perhaps making a bulge 27 in the shooting string section 1. Another example of the multi layer shooting string section 1 is shown in FIG. 4. In another alternative preferred embodiment the tension string 24 attaches to the ends of the shooting string section at the points 15 and does not extend through the shooting string section 1. The attachment points 15 may be placed in any convenient place on the shooting string section 1 and is not restricted to the locations shown in FIG. 2. The end of the tension string opposite the tension box in this figure is displayed as if it would reverse direction 28 either around one of the flexible elements 8 or one of the side walls 20 of the stick head frame 9. In an alternative application, a separate tension element 24 may also be fastened between the shooting string section 1 and the side wall 20 without reversing direction.

Figure 3:
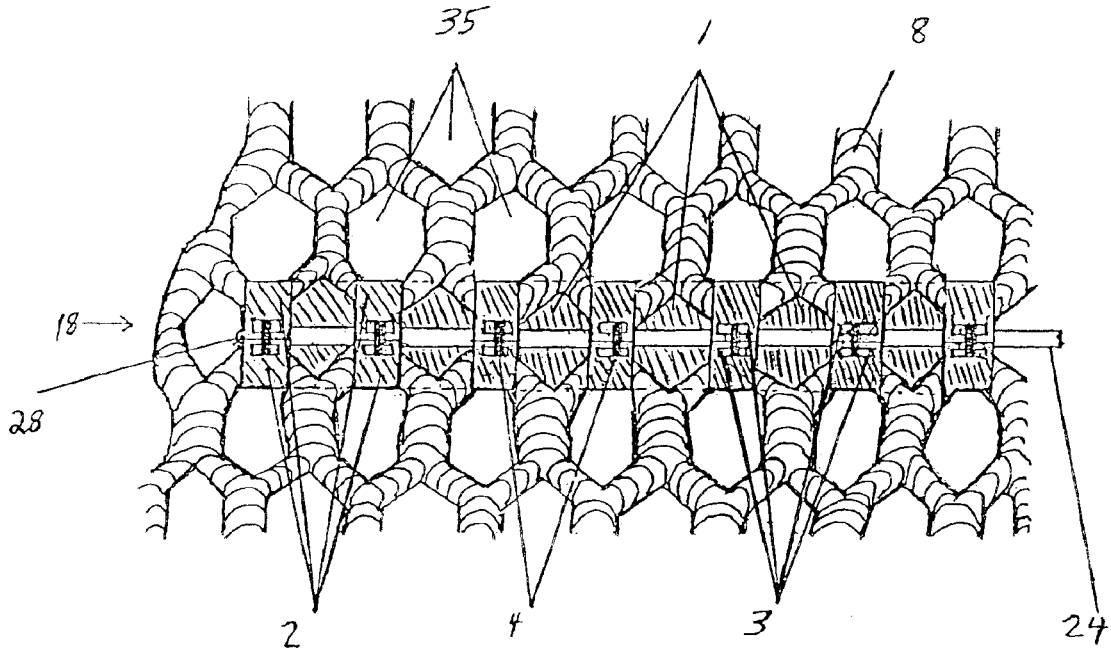
FIG. 3 is the shooting string section with flaps shown in FIG. 2 now viewed looking at the back of the pocket with the flaps closed and fastened around the netting material of a typical stick head. This is the view of the shooting string section with the flaps folded after it is fastened into the stick head.

Shown in FIG. 3 is the shooting string section 1 with flaps 2 viewed looking at the back of the pocket with the flaps 2 closed and fastened together around the netting string material flexible elements 8 of a typical stick head 11. The flaps 2 of this embodiment are sufficiently long to encompass the netting material flexible elements 8. In an alternative preferred embodiment the flaps 2 may extend one-third or greater around the netting material flexible elements 8. Connector rings 4 or elongated connector rings 4 or other flexible elements 8 may fasten the flaps 2. In the FIG. 3 view, the ball would sit on the opposite side of the flexible elements, thongs or netting material 8 of the stick head 11 from the viewer. This is called the back view. The side walls components of the head 20 and the frame 9 are not shown in this view. In one alternative preferred embodiment, the tension element 24 extends through the shooting string section 1 around a selected turning point flexible element 28 located in the shooting area of the stick head 12 and then passes through the aligned connector rings 4 on a ring passage guiding path 18. The tension element 24 then may be either tied to the side wall component of the head 20 extend through the finely continuously adjustable mechanism 7. In FIG. 3, the view through the flexible elements 8 to the shooting string section 1 mounted on the opposite side away from the viewer is displays the shooting string section 1 as shaded while the empty spaces 35 are not shaded. In another embodiment not shown, the finely continuously adjustable mechanism 7 may be located at each end of the tension element 24.

FIG. 4 illustrates an alternative embodiment of the shooting string section 1 without flaps 2 and without a tube 27. In this embodiment the tension element may extend between multi layers 34 on the broad side 32 of the shooting string section 1. This embodiment of the shooting string section 1 may be fastened to the flexible elements 8 of the shooting string section 12 of the head 11 by connector rings 4 punched through the edges of the shooting string section 1 by lacing around the edges, particularly along the length dimension 14. Other fastening members known in the art may also be used to fix the long or length edge of the shooting string section 1 to the flexible elements 8. Holes may exist along the edge of the length dimension 14 to aid in fastening. Glue with material extension arrangements may also be used. Multi-time detachable flaps 2 and one-time attachable flaps 2 may also be used to efficiently locate the flaps between the openings of the netting strings 8. Flaps 2 capable of sliding for at least some distance in the length dimension 14 may also be employed. The dimensions of this embodiment are that the length dimension 14 be greater than the width dimension 29. As in the other alternative embodiments, the width must be sufficient to wrap at least one-third of the way around the flexible elements 8. As with all of the other embodiments of this invention, there are no elements interwoven with the flexible elements 8 of the web.

Figure 5A:
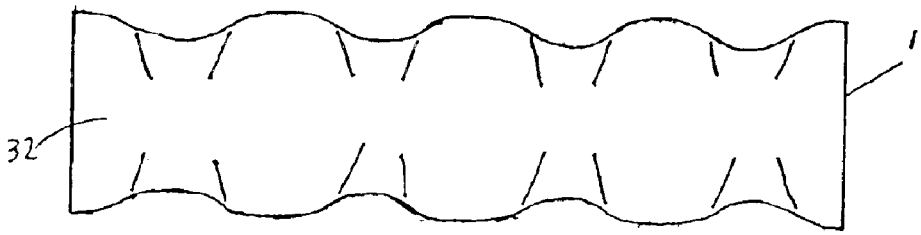
FIGS. 5A and 5B are front and side views respectively of an alternative preferred embodiment of the new shooting string section without flaps that is permanently formed into a shape to interlock with the webbing or thong elements of a stick head and without any tube or shooting projection shown attached. These views also illustrate how the shooting string section of FIG. 4 will begin to appear as the shooting string section is fastened to the flexible elements.
Figure 5B:
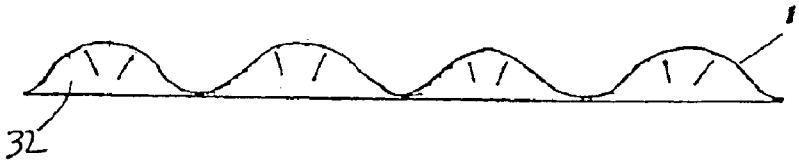

FIG. 5A illustrates how the shooting string section 1 of FIG. 4 will form as it is pulled between the flexible elements 8 of the stick head 11. FIG. 5A is also the front view of an alternative preferred embodiment of the shooting string section 1 without flaps 2 that is permanently formed into a shape to interlock with the webbing, netting strings or thong elements 8 of a stick head 11 and without any tube 27 or shooting projection shown affixed thereto. In other preferred embodiments a built up or thickened area may be used on the shooting string section 1. In the embodiments of FIGS. 4 and 5, tension elements 24 are attached at the length dimension 14 ends of the shooting string section 1. In alternative preferred embodiment the shooting string section 1 may extend to form integrated tension elements 24 that may be fastened to the side wall components of the head 20, the flexible elements or netting strings 8, and the finely continuously adjustable mechanisms 7. FIG. 5B is side of the view of the shooting string section 1 presented in FIG. 5A.

The shooting string section 1 may be made of any material. In one of the preferred embodiments of the invention, leather performed satisfactorily. The shooting string section 1 when used in the preferred embodiments without flaps 2 may also work efficiently if a slightly elastic or stretchable material is used.

What is claimed is:

1. A device for a sport stick head having a frame and one or more flexible elements selected from a group consisting of strings, thongs, netting strings and shooting strings that are strung within the frame with the flexible elements having a length and tension, comprising for use in a lacrosse stick head as a part of a lacrosse stick that is held by a lacrosse player's hands during lacrosse play a finely and continuously adjustable mechanism turnable by hand that meters and holds the length and tension of at least one of the flexible elements to a desired length and tension, wherein the finely and continuously adjustable mechanism is selected from a group comprising friction wheels, spooling devices, violin/guitar string tension mechanisms, turnable keys and hollow screws, wherein at least one of the shooting strings further comprises a shooting string section that has a width dimension and a length dimension greater than the width dimension, with the width dimension being sufficient to wrap at least one-third of the way around at least one of the flexible elements, wherein the shooting string section has multiple flaps that extend out in the width dimension along each side of the length dimension.

2. A shooting string apparatus for a sports stick having a head provided with a top portion component and a base portion component interconnected by a pair of side wall components having an opening within the foresaid head components with flexible elements strung in the opening, comprising for use in a lacrosse stick head as a part of a lacrosse stick that is held by a lacrosse player's hands during lacrosse play a shooting string section with a length dimension greater than the width dimension that folds in the width dimension at least one-third over at least one of the other of the flexible elements in a manner to assist in holding the shooting string section adjacent to the flexible elements, with a tension element that extends through the shooting string section in generally the direction of the length dimension, with adjustable length and tension of the tension element, wherein the length and tension of the tension element is changed by a finely and continuously adjustable mechanism turnable by hand that meters and holds the length and tension of the flexible elements to a desired length and tension, wherein the mechanism comprises one or more metering and holding devices selected from a group comprising friction wheels, spooling devices, violin/guitar string tension mechanisms, turnable keys and hollow screws, wherein the shooting string section further comprises at least two pieces of material fastened together such that the tension element is sandwiched between the broad sides of the pieces allowing the tension element to be contained within the perimeter of the length dimension of the shooting string section and simultaneously allowing the tension element to moveably extend through the shooting string material.

3. A shooting string apparatus as in claim 2 wherein the shooting string section further comprises multiple flaps along at least one side of the length dimension that extend out in the width dimension and, by folding over at least one-third of the circumference of at least one of the other flexible elements within the head opening, thereby assisting in holding the shooting string section in constrained proximity to the other flexible elements.

4. A shooting string apparatus as in claim 3 wherein at least one of the flaps is at least one time detachable and capable of being positioned along the length dimension of the shooting string section.

5. A shooting string apparatus as in claim 3 wherein at least one flap is capable of being repositioned along each side of the length dimension of the shooting string section.

6. A shooting string apparatus as in claim 3, wherein the flaps have holes that may be named channels through which connector rings are able to pass with a connector ring simultaneously holding opposing flaps in constrained proximity and with at least some of the connector rings forming a guiding path through which a flexible element may be extended.

7. A shooting string apparatus as in claim 6 comprising the tension element further passing around a turning point and then extending through the ring passage guiding path formed by the connector rings and then passing into the finely continuously adjustable mechanism.

8. A shooting string apparatus for a sport stick, comprising, for use in a lacrosse stick head provided with a top portion component and a base portion component interconnected by a pair of side wall components having an opening within the foresaid head components with flexible elements strung in the opening as a part of a lacrosse stick that is held by a lacrosse player's hand during lacrosse play, a shooting string section with a length dimension greater than the width dimension, wherein the shooting string section further comprises multiple flaps along at least one side of the length dimension of the shooting string section, with the flaps extending out in the width dimension to such a length as to be capable of folding at least one-third over at least one of the flexible elements and thereby holding the shooting string section in constrained proximity to the at least one of the flexible elements, wherein the shooting string section further comprises at least one extension on at least one end of the shooting string section in the length dimension that holds the shooting string section in tension.

9. A shooting string apparatus as in claim 8 wherein the shooting string section is held in tension by a finely and continuously adjustable mechanism turnable by hand that meters and holds the length and tension of at least one of the extensions of the shooting string section to a desired length and tension, wherein the mechanism comprises one or more metering and holding devices selected from a group comprising friction wheels, spooling devices, violin/guitar string tension mechanisms, turnable keys and hollow screws.

10. A shooting string apparatus for a sports stick, comprising, for use in a lacrosse stick head provided with a top portion component and a base portion component interconnected by a pair of side wall components having an opening within the foresaid head components with flexible elements strung in the opening as a part of a lacrosse stick that is held by a lacrosse player's hands during lacrosse play, a shooting string section with a length dimension greater than the width dimension, wherein the shooting string section futher comprises multiple flaps along at least one side of the the length dimension of the shooting string section, with the flaps extending out in the width dimension to such a length as to be capable of folding at least one-third over at least one of the flexible elements and thereby holding the shooting string section in constrained proximity to the at least one of the flexible elements, further comprising an interface for contact with a tension element, wherein the interface is selected from a group consisting of a means to fasten the tension element to the shooting string section, at least one extension on at least one end of the shooting string section in the length dimension that holds the shooting string section in tension, and a capability to accomodate a tension element extending through the interior of the shooting string section, wherein the interior of the shooting string section is defined when the flaps are not considered.

11. The shooting string section of claim 10 comprising multiple flaps along each side of the length dimension of the shooting string section.

* * * * *